US005284249A

United States Patent [19]

Lawrence et al.

[11] Patent Number: 5,284,249

[45] Date of Patent: Feb. 8, 1994

[54] DIRECT HYDRAULIC DRIVE FOR LARGE FLOTATION CELLS

[75] Inventors: George A. Lawrence, Weston; Andres Paredes, Stamford; Roderick R. Roy, Milford, all of Conn.

[73] Assignee: Dorr-Oliver Incorporated, Milford, Conn.

[21] Appl. No.: 13,843

[22] Filed: Feb. 5, 1993

[51] Int. Cl.[5] ..... B03D 1/16

[52] U.S. Cl. ..... 209/169; 210/221.1; 210/167; 261/87; 261/93; 60/486; 60/454; 417/429

[58] Field of Search ..... 209/169; 60/486, 454; 417/429; 210/221.1, 167; 261/87, 93; 366/102, 250

[56] References Cited

U.S. PATENT DOCUMENTS

| | | | |
|---|---|---|---|
| 2,011,483 | 8/1935 | Hansen | 209/169 |
| 2,928,543 | 3/1960 | Logue | 209/169 |
| 3,962,870 | 6/1976 | Lech | 60/486 |
| 4,030,296 | 6/1977 | Deinlein-Kalb | 60/486 |
| 4,191,018 | 3/1980 | Barrett | 417/429 |
| 5,032,065 | 7/1991 | Yamamuro | 417/429 |
| 5,094,597 | 3/1992 | Takai | 417/427 |

FOREIGN PATENT DOCUMENTS

| | | | |
|---|---|---|---|
| 1920952 | 4/1969 | Fed. Rep. of Germany | 417/428 |
| 3524790 | 1/1987 | Fed. Rep. of Germany | 417/429 |
| 147902 | 11/1981 | Japan | 60/486 |

*Primary Examiner*—Thomas M. Lithgow
*Attorney, Agent, or Firm*—DeLio & Peterson

[57] ABSTRACT

A flotation apparatus for floating minerals from fluid containing minerals in particulate form. The flotation apparatus includes a hydraulic motor directly connected to a drive shaft for driving a rotor located in the flotation cell, the hydraulic motor being powered by a hydraulic power pack having dual gear pumps to circulate hydraulic fluid at pressures of up to 2900 psi to drive the hydraulic motor. The dual gear pumps include a smaller gear pump for developing high pressure at low flow for quick, soft start of the flotation apparatus. Once started, the larger pump automatically takes over to provide high flow at lower pressure to develop rotor speed of approximately 160 RPM.

3 Claims, 3 Drawing Sheets

FIG. 2B
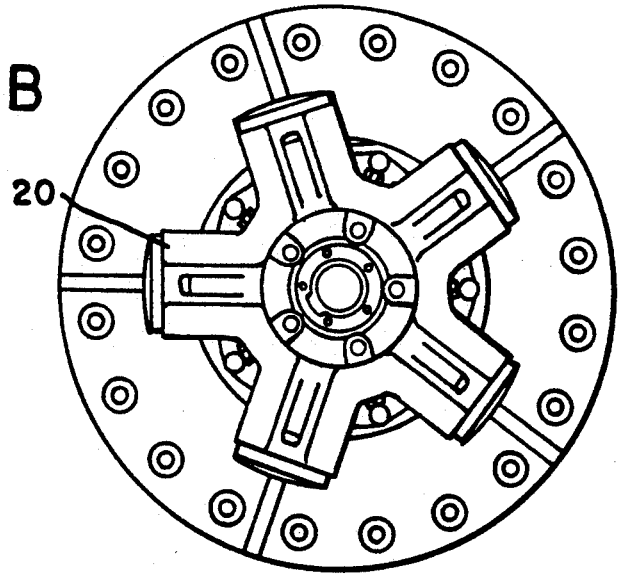
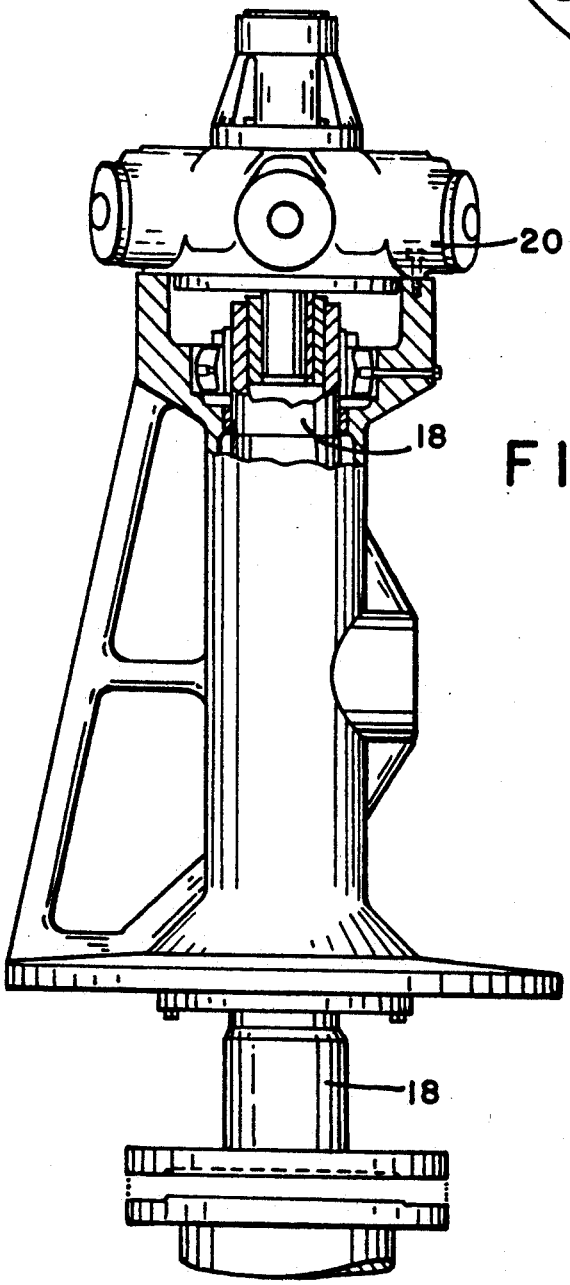
FIG. 2A

DIRECT HYDRAULIC DRIVE FOR LARGE FLOTATION CELLS

FIELD OF THE INVENTION

The present invention relates to a flotation device that is capable of floating particles, such as mineral particles, in an upward flow of air bubbles that counteracts the adverse effect of gravity. The machine includes a flotation cell and a mixing device located in the cell, and separates minerals or other particles from undesirable byproducts.

BACKGROUND OF THE INVENTION

Flotation machines are commonly used to separate solid materials by agitating fluid containing the desired material. An impeller located in the flotation cell creates the agitation and aerates the fluid, thus dispersing air contained in the pulp so that air bubbles develop to which the particles of the material being separated stick. As the particles rise with the air bubbles to the surface, a froth byproduct forms on the surface and has a higher concentration of the floatable material, as compared to the starting product.

Flotation cells can be used to separate crushed ore, sewage or many other products, as long as one of the products is floatable, i.e., can stick to the air bubbles.

Conventional flotation cells primarily make use of large, cumbersome horizontal drive belt arrangements which are connected to expensive low-speed electric motors. Shaft-mounted vee-belt drives are commonly employed and are driven by electric motors connected via drive belts. Other systems include shaft-mounted horizontal gear reducers with vee-velt drives and fixed-speed gear motors. All of these systems have various drawbacks.

Such conventional flotation cells are incapable of a soft start, but rather change abruptly from an inoperative state to full speed. None of these systems has variable speed capability, and thus are incapable of being tuned to the feed characteristics at which the liquid being inputted is fed into the flotation cell. The complex belt structures of the conventional flotation cells, and the expensive electric motors, require significant maintenance and considerable part replacement due to wear. Conventional cells have multiple drive belts, large sheaves, large drive guards, motor mounting brackets and bearing housing mounting brackets, all of which increase the expense and complexity of the flotation cell systems. Furthermore, most conventional drive systems for flotation cells include radial bearing loads; bearings, seals and housings are large, and consequently have a greater likelihood of breakdown, are more expensive and need more maintenance. Finally, it is very difficult to run conventional flotation cells under computer control to monitor or vary the rotor speed torque and energy consumption.

For example, U.S. Pat. No. 5,039,400 relates to a flotation machine for floating minerals from slurries containing minerals in particulate form. The flotation cell includes a mixing mechanism which has a stator and a rotor. The rotor is attached to a hollow axis which is geared with bearings to the supporting structures of the cell. An electric motor rotates the axis through intermediate cone belts. Such a flotation device suffers from the previously described drawbacks, namely it utilizes expensive low-speed electric motors and complicated belt driving mechanisms, and furthermore, is incapable of a soft start, and fails to permit an operator to vary the speed to match the performance to changes in feed characteristics.

Another apparatus is shown in U.S. Pat. No. 4,043,909 which is an apparatus and method for solidification of sludges. The apparatus includes a driving means which includes a prime mover such as a hydraulic motor and reduction gear. This reduction gear includes four output shafts, each of which is connected to an agitating shaft through a bearing, and a shaft coupling. While U.S. Pat. No. 4,043,909 does not require the use of belts, the inclusion and utilization of the complex reduction gear system requiring multiple output shafts, agitating shafts, bearings and couplings, adds to the complexity and expense, further requiring greater downtime for maintenance and increases the frequency of wearing down of parts. Furthermore, the system is not capable of soft starting or speed variance over a large range.

SUMMARY OF THE INVENTION

In view of the foregoing, an object of the present invention is to provide an improved flotation cell capable of a soft start.

Another object of the present invention is to provide a flotation cell having variable speed, so that the rotor speeds are infinitely variable over a wide range to suit each application.

Yet another object of the present invention is to provide a flotation cell which requires lower maintenance and permits the rapid changing of worn parts, so that the cell has reduced downtime.

Another object of the present invention is to provide a flotation cell having a compact hydraulic motor and power pack arrangement.

Still another object of the present invention is to provide a flotation cell having a hydraulic motor mounted directly on the flotation mechanism shaft and in-line, eliminating the need for any couplings or reducers.

Yet another object of the present invention is to provide a flotation cell in which the pressure drop in flow rate of hydraulic fluid across a hydraulic motor for driving the flotation mechanism shaft can be easily measured and computer controlled to monitor or vary rotor speed torque and energy consumption.

Still another object of the present invention is to provide a flotation cell which has smaller head room requirements due to the compact assembly of the drive arrangement, thus lowering construction costs.

In order to achieve the foregoing and other objects, the present invention consists of a compact hydraulic motor which is attached directly to the upper shaft of the flotation mechanism and mounted directly on the compact cast iron bearing housing. The hydraulic motor is driven by a hydraulic power pack installed adjacent to the bearing housing. Dual gear pumps in the power pack circulate hydraulic fluid at pressures of up to 2900 psi to drive the hydraulic motor. The smaller gear pump develops this high pressure at low flow for a quick, soft start of the flotation mechanism. Once started, the larger pump automatically takes over to provide the high flow at a lower pressure, as needed, to develop the necessary rotor speed.

BRIEF DESCRIPTION OF THE DRAWINGS

The invention will now be described with reference to the drawings of this application, in which:

FIGS. 2A and 2B are a side and top view of the drive assembly of the preferred embodiment;

DETAILED DESCRIPTION OF THE PREFERRED EMBODIMENT

Figure 1:
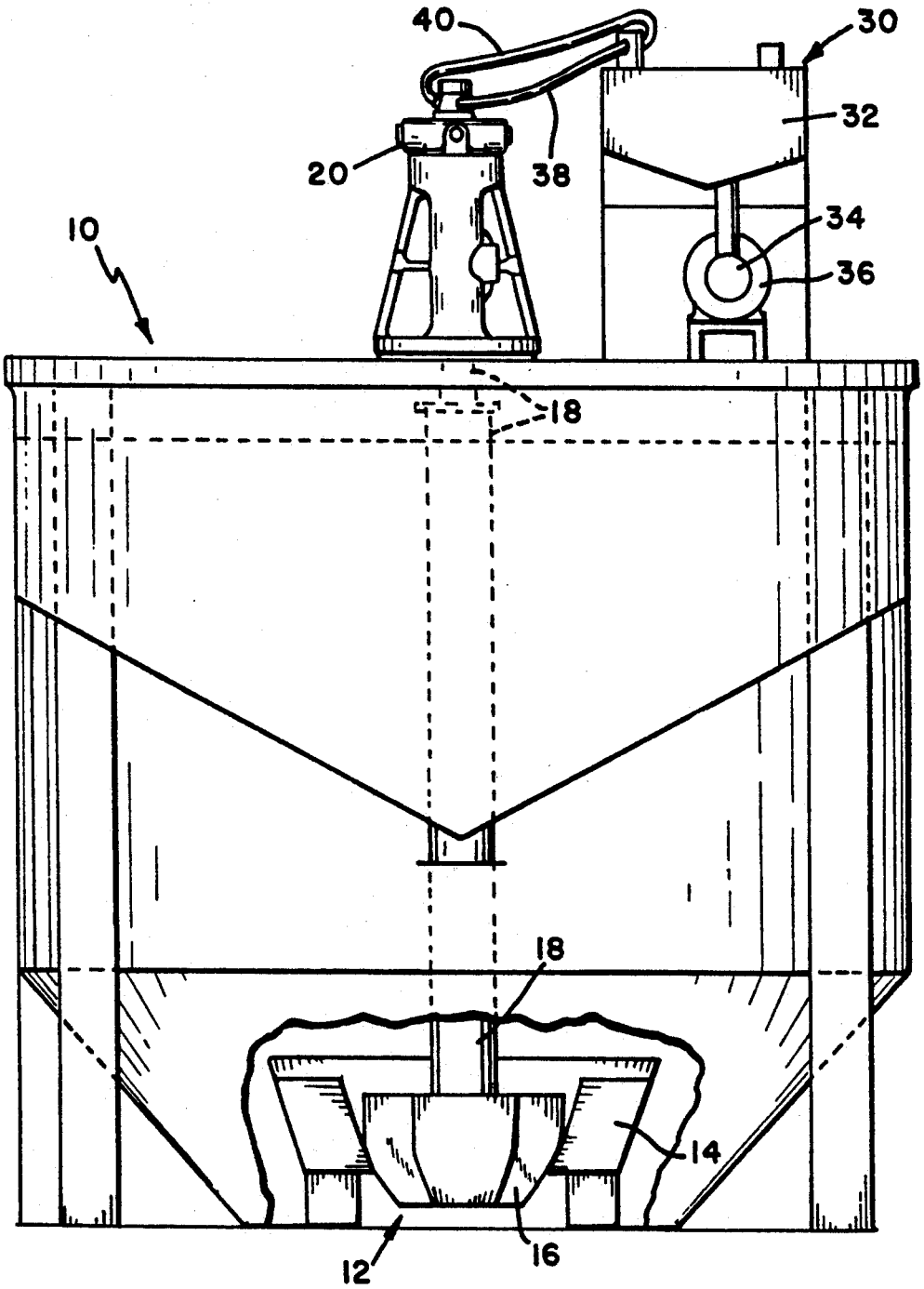
FIG. 1 is a side view illustrating a preferred embodiment of the apparatus.
Figure 3:
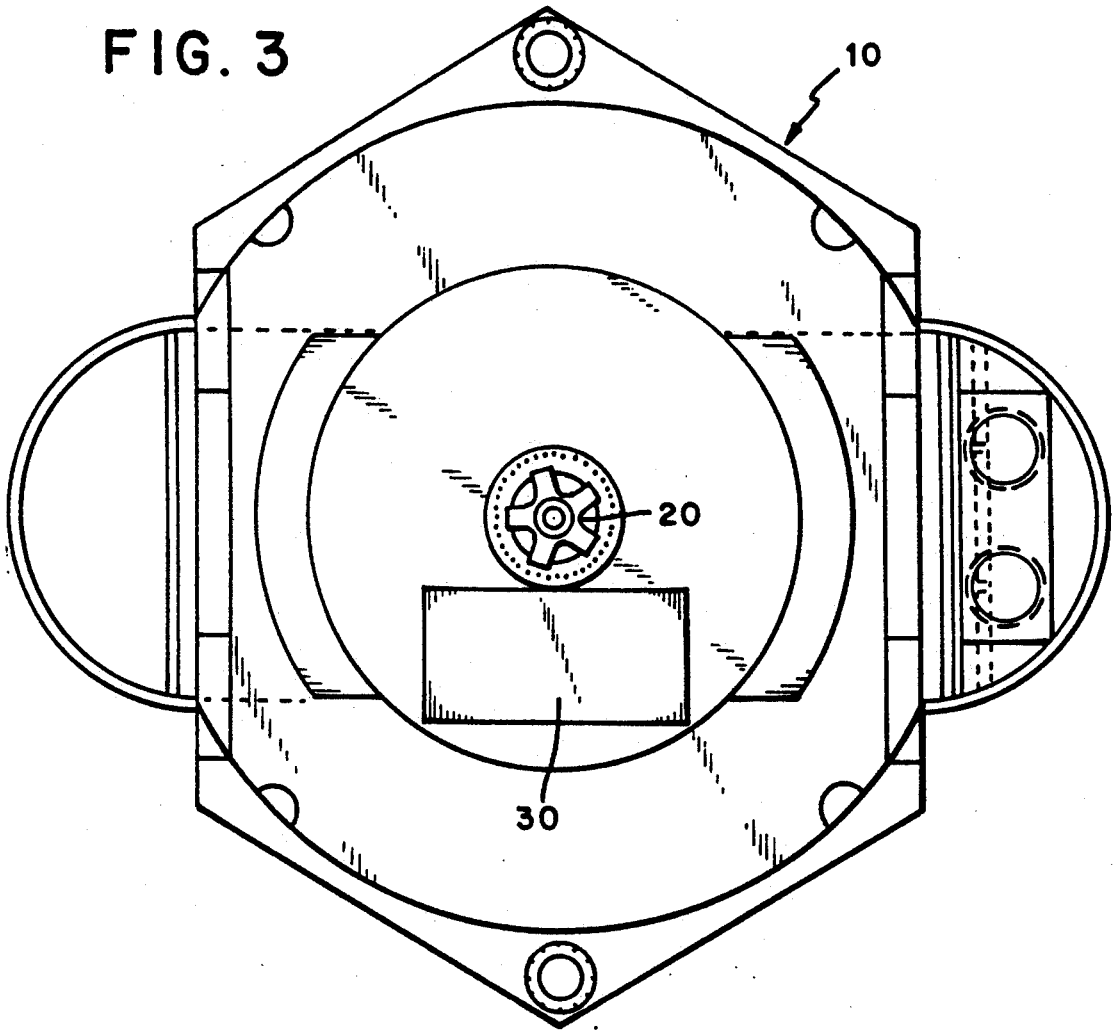
FIG. 3 is a top view of the flotation cell shown in FIG. 1.

Referring to FIG. 1, inside the flotation cell 10 there is an agitator 12 including a stator 14 and rotor 16. The rotor 16 is attached to a drive shaft 18 which extends downward from a drive mechanism, namely hydraulic motor 20. The drive mechanism 20 is directly attached to the drive shaft 18 so that rotation of the drive shaft 18 occurs as a result of the direct driving of the drive mechanism 20. The bottom of the flotation cell 10 is designed to form a truncated cone, in a conventional manner, to facilitate the agitation of the fluid containing the minerals to be separated. As shown in FIGS. 1 and 3, a hydraulic power pack 30 is located adjacent the hydraulic motor 20 on the top of the flotation cell 10. The hydraulic power pack 30 includes a hydraulic fluid reservoir 32, a pump 34, electric motor 36, power hose 38 and return hose 40. The motor 20 and hydraulic power pack 30 are interconnected by the return hose 40 and power hose 38. The motor 20 is driven by the hydraulic fluid flowing through the power hose 38, which is returned by the return hose 40 to the hydraulic fluid reservoir 32 of the hydraulic power pack 30. The fluid speed of the hydraulic fluid is controlled by the pump 34, which is infinitely variable over a wide range in order to suit each application. In this manner, the speed at which the motor 20 operates can be varied infinitely to coordinate the agitation with the mineral separation to optimize this effect. The power pack 30 drives only the single hydraulic motor 20 of one flotation cell 10, rather than being a much larger mechanism for driving multiple cells. In this manner, the operation of the power pack 30 can be carefully controlled to optimize the mineral separation for an individual flotation cell 10. The pump 34 in the hydraulic power pack 30 has a dual gear arrangement to circulate hydraulic fluid at pressures of up to 2900 psi to drive the hydraulic motor 20. The smaller gear pump 44 (see FIG. 4) develops the high pressure of approximately 2900 psi at low flow for a quick, soft start of the hydraulic motor 20 and rotor 16. Once the hydraulic motor 20 is started, the larger pump 46 automatically takes over to provide the high flow at lower pressure, which is necessary to develop a rotor speed of 160 RPM.

Figure 4:
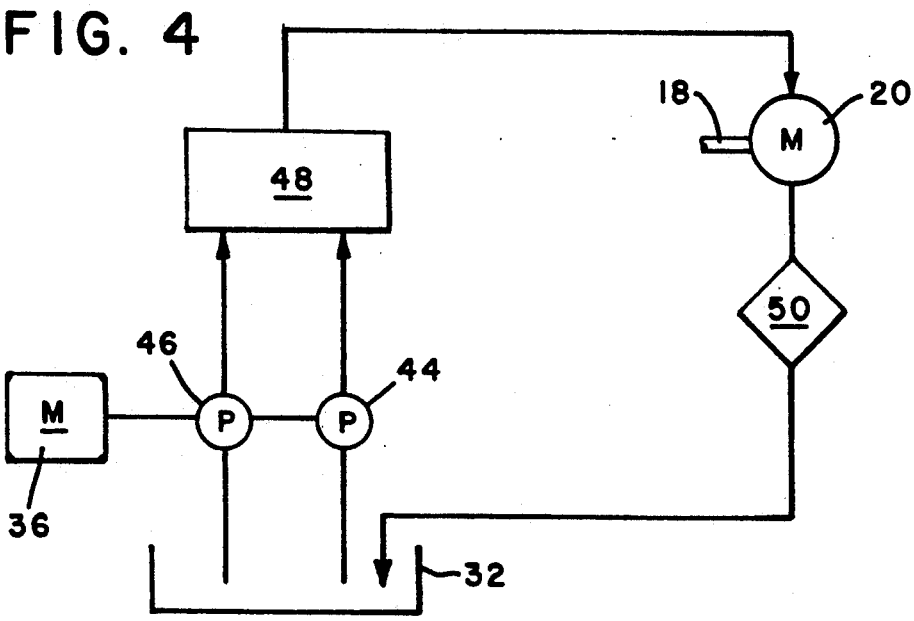
FIG. 4 is a schematic diagram showing the layout of the present invention.

Referring to the schematics of FIG. 4, the dual pump arrangement is illustrated. In FIG. 4, it can be seen that the low pressure, high RPM pump 44 is powered by the electric motor 36 to draw fluid from the reservoir 32 and feed it to the pressure flow control instruments 48. The pressure flow control instruments 48 then feed the fluid to the hydraulic motor 20 connected to the drive shaft 18. The fluid is then sent back to the reservoir 32 after being filtered through a filtering system 50. Once the flotation cell 10 is started, the high torque, low RPM pump 46 is initiated and the low pressure, high RPM pump 44 ceases functioning. Thus, the hydraulic fluid is now fed through the high torque, low RPM pump 46 under the guidance of the pressure and flow control instruments 48 to cause the drive shaft 18 to rotate at the rotor speed of 160 RPM.

Utilization of this dual pump arrangement eliminates the need for complicated belt arrangements or shaft-mounted gear reducers. The hydraulic motor 20 mounted on the top of the flotation cell 10 and shown in FIGS. 2A and 2B is directly connected to the drive shaft 18 and is therefore significantly more compact than conventional flotation cells. The present invention allows for the soft starting of the flotation cell 10 when restarting after a shutdown. The low pressure, high RPM pump 44 achieves the soft start at fluid pressures approaching 2900 psi so that the apparatus starts smoothly. Once the apparatus is started, the high torque, low RPM pump 46 takes over to maintain the desired mineral separation operation. The speed of shaft rotation can be varied either manually or automatically. In manual operation, it is a simple matter for the operator to adjust the pressure and flow control instruments 48. In this manner, the operator can fine tune the cell performance to match changes in feed characteristics or mineral content. In an automatic application, it is a simple matter to put the pressure and flow control instruments 48 under computer control which could be responsive to sensors located in the hydraulic motor, the drive mechanism, the hydraulic lines and the flotation cell to optimize operation of the apparatus automatically.

Since the present invention reduces the amount of parts necessary to drive the drive shaft 18 by eliminating the need for complicated belt mechanisms or complicated gear reducers, the present flotation cell requires significantly less maintenance than conventional flotation cells. Furthermore, the parts can be much more quickly replaced which decreases the amount of time that the flotation cell is out of operation.

The compact hydraulic motor 20 and power pack 30 replaces conventional flotation cells' use of multiple belts, large sheaves, large drive guards, motor mounting brackets and bearing housing mounting brackets. The elimination of these parts reduces the costs of the flotation cell and the likelihood of a failure.

As shown in FIG. 1, the hydraulic motor 20 is mounted directly on the flotation mechanism drive shaft 18 and in-line, without the need for any couplings or reducers. Consequently, the radial bearing loads are eliminated. Bearings, seals and housing are thus much smaller than would be needed with conventional drive arrangements which transmit radial bearing loads.

As a result of the hydraulic power pack 30 and hydraulic motor 20 arrangement shown in FIGS. 1 and 3, it is a simple matter to measure the pressure drop and flow rate of hydraulic fluid across the hydraulic motor 20, and it is a simple matter to make this measurement computer controllable to monitor or vary rotor speed, torque and energy consumption.

As a direct consequence of the arrangement of the present invention, the hydraulic motor 20 shows significant economic benefits, namely, improved overall metallurgical performance since rotor speeds are variable to optimize process performance requirements. The flotation cell 10 requires less overall downtime due to the ease of maintenance and soft start after any shutdown on the load. The performance can be optimized at all times by computer control of operating parameters such as rotor speeds, torque and energy efficiencies. Furthermore, the reduced headroom requirements due to the compact assembly of the drive arrangement result in lower construction costs.

The foregoing embodiment of the present invention has been described as an example, and it will be evident to one skilled in the art to make adaptions and modifications without departing from the spirit and scope of the invention.

What is claimed is:

1. A flotation apparatus for removing mineral particles from fluid containing such particles comprising:

a flotation cell for containing the fluid containing the particles;

a mixing means comprising a stator and rotor located inside the flotation cell;

drive means comprising a drive shaft and a hydraulic motor mounted in-line with said drive shaft for directly driving said drive shaft and said rotor connected to said drive shaft;

sensor means for detecting and measuring the pressure drop and flow rate of hydraulic fluid across the hydraulic motor;

a hydraulic power pack means for powering said hydraulic motor, said power pack means comprising:

instrument means for controlling the pressure and flow of hydraulic fluid to modify cell performance by varying rotor speed, torque and energy consumption;

a high torque, low speed rotation pump for starting said hydraulic motor;

a low torque, high speed rotation pump for maintaining the continuous operation of said mixing means;

a computer means responsive to the output of said sensor means to actuate said instrument means for adjustment of said pressure drop and flow rate of hydraulic fluid; and a motor for powering said pumps.

2. A flotation apparatus as recited in claim 1, wherein said hydraulic power pack means further comprises a hydraulic fluid reservoir, a power hose for powering said hydraulic motor with hydraulic fluid and a return hose for returning hydraulic fluid to said fluid reservoir.

3. A flotation apparatus as recited in claim 2, further comprising a filter means for filtering said hydraulic fluid before returning the hydraulic fluid from said hydraulic motor to said reservoir.

* * * * *